US006598595B2

(12) United States Patent
Yasui

(10) Patent No.: US 6,598,595 B2
(45) Date of Patent: Jul. 29, 2003

(54) BREATHER DEVICE FOR MOTORCYCLE

(75) Inventor: Nobuhiro Yasui, Hamamatsu (JP)

(73) Assignee: Suzuki Motor Corporation, Hamamatsu (JP)

( * ) Notice: Subject to any disclaimer, the term of this patent is extended or adjusted under 35 U.S.C. 154(b) by 0 days.

(21) Appl. No.: 10/241,903

(22) Filed: Sep. 11, 2002

(65) Prior Publication Data

US 2003/0070661 A1 Apr. 17, 2003

(30) Foreign Application Priority Data

Oct. 12, 2001 (JP) ..... 2001-315226

(51) Int. Cl.[7] ..... F01M 13/00
(52) U.S. Cl. ..... 123/572
(58) Field of Search ..... 123/572, 573, 123/574, 41.86

(56) References Cited

U.S. PATENT DOCUMENTS 4,662,322 A * 5/1987 Tamba et al. ..... 123/41.86
4,840,152 A * 6/1989 Watanabe et al. ..... 123/41.86
5,690,084 A * 11/1997 Gunji et al. ..... 123/572
6,142,129 A * 11/2000 Hori et al. ..... 123/572
6,334,438 B1 * 1/2002 Itoh et al. ..... 123/572

FOREIGN PATENT DOCUMENTS

| | | |
|---|---|---|
| JP | 56-121812 | 9/1981 |
| JP | 63-120808 | 5/1988 |
| JP | 04-012108 | 1/1992 |
| JP | 09-042046 | 2/1997 |

* cited by examiner

*Primary Examiner*—Marguerite McMahon
(74) *Attorney, Agent, or Firm*—Darby & Darby

(57) ABSTRACT

The present invention provides a breather device for a water-cooled V-type engine with a breather device in which a breather chamber effectively utilizes the available space in an engine. A water-cooled V-type engine includes a crankshaft that extends into a crankcase in the widthwise direction of the motorcycle. On a side wall of the crankcase that connects with the end of the crankshaft, there is a side cover that is located over a clutch mechanism in the rear of the crankcase. A breather chamber is formed within the space contained between the side cover and an oil separator and is positioned in front of the clutch mechanism. A shaft that rotates with and is parallel to the crankshaft is located between a set of front and rear cylinder assemblies and is right above the crankshaft. This shaft drives a cooling-water pump which is located outside the side cover.

7 Claims, 9 Drawing Sheets

BREATHER DEVICE FOR MOTORCYCLE

FIELD OF THE INVENTION

The present invention relates to a breather device for a motorcycle having a water-cooled V-type engine.

BACKGROUND OF THE INVENTION

In an engine, gas pressurized in the cylinder bore gradually leaks into the crankcase through a gap between the piston and the cylinder bore. This leaked gas is known as blow-by gas. The pressure of the gas in the crankcase fluctuates as the piston slides, and if the crankcase is hermetically sealed, piston movement is inhibited. Therefore, it is necessary to release the blow-by gas and to separate the oil mist mixed in the blow-by gas with a breather device. In recent years, engines have been made to circulate blow-by gas to an air cleaner to be burned again, thereby preventing air pollution.

A breather chamber within a breather device requires a minimum capacity to separate oil mist from the blow-by gas. However, the layout of a motorcycle engine and the desire to reduce the size of the motorcycle engine make it difficult to store a sufficiently-sized breather chamber. Therefore, a separate breather device must be added, which increases the size, the number of components, and the cost of the engine.

The present invention addresses these problems and provides a simple motorcycle breather device that can effectively utilize available space, thereby reducing the size of the engine.

SUMMARY OF THE INVENTION

The present invention provides a breather device for a motorcycle having a water-cooled V-type engine. This type of engine has a crankcase which includes a crankshaft that extends in the crankcase in the widthwise direction of the motorcycle, a plurality of front and rear cylinder assemblies that form a V-shaped profile, a clutch at the rear of the crankcase, and a side cover. The clutch and one end of the crankshaft join at a side wall of the crankcase which is covered by the side cover. Inside this side cover, a breather chamber is formed in the space between the portion of the side cover in front of the clutch mechanism and a platelike oil separator. A shaft, such as a pump shaft, that rotates with the crankshaft is placed parallel to and above the crankshaft between the front and rear cylinder assemblies. A cooling-water pump driven by the pump shaft is placed outside the side cover.

An oil pan can be used to store lubricating oil under the crankcase. This oil pan communicates with the breather chamber through an oil return hole on the lower end of the oil separator. When the motorcycle is running, the level of lubricating oil in the oil pan rises above this oil return hole.

A breather entrance can be formed in the oil separator adjacent to a rotary member, such as an idler-shaft driven gear, thereby transferring the blow-by gas to the breather chamber.

The breather chamber can be divided into an upper and a lower segment by an extended portion formed between the side cover and the oil separator, above the oil return hole and below the end of the crankshaft. This division makes maintenance easier.

The extended portion can contain a check valve that allows the lubricating oil to flow only from the upper segment of the breather chamber into the lower segment of the breather chamber, thereby preventing backflow if the motorcycle tilts.

The shaft that drives the valve mechanism, such as the cam-chain idler shaft, can be coaxial to the shaft that drives the cooling-water pump, such as the pump shaft, thereby making the engine more compact.

A pair of sprockets for driving the valve mechanism, such as a pair of cam-chain driving sprockets, can be placed at the ends of the cam-chain idler shaft which is coupled with the pump shaft. The cooling-water pump is placed beside the gear that is coupled to the crankshaft, such as the idler-shaft driven gear, which is beside one of the sprockets for driving the valve mechanism. This increases engine life.

With the configuration described above, the present invention provides a motorcycle breather device in which a breather chamber effectively utilizes the available space in an engine. The resulting engine is more compact, has fewer components, and has a simpler structure.

DESCRIPTION OF THE PREFERRED EMBODIMENTS

Figure 1:
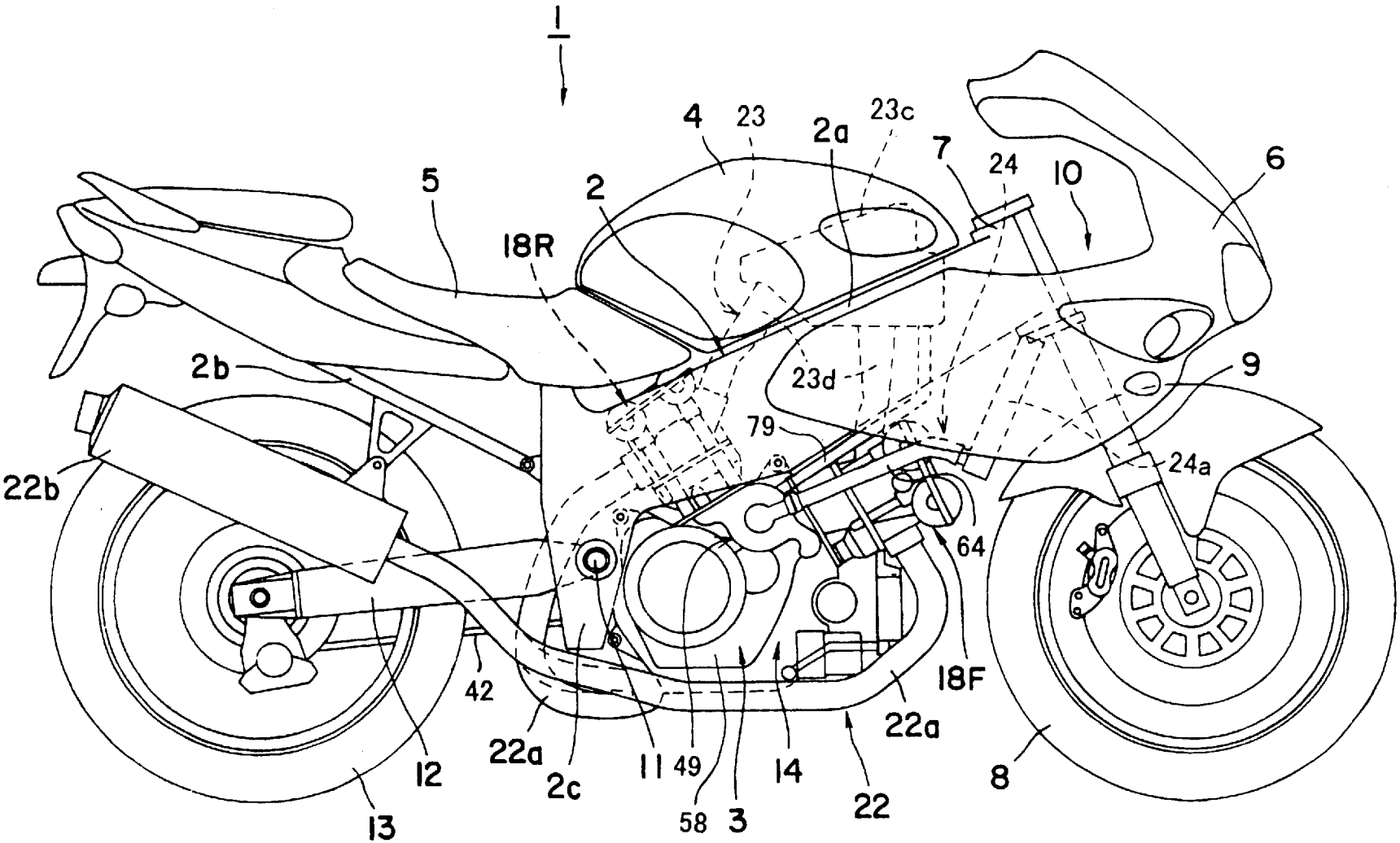
FIG. 1 is a right side view of the motorcycle with a breather device, according to the present invention.

As shown in FIG. 1, a motorcycle 1 includes a body frame 2 and an engine 3 mounted at the lower front of the body frame 2. A fuel tank 4 is located above the engine 3, and the rider's seat 5 is located at the rear of the fuel tank 4. A streamlined cowling 6 is attached to the front of the body of the motorcycle 1 to reduce air resistance and to protect the rider when riding.

A head pipe 7 in front of the body frame 2 includes a steering mechanism 10 with a pair of right and left front forks 9 to support the front wheel 8, a handle bar (not shown), and the like when turning.

The body frame 2 can have a twin tube structure that includes a pair of right and left main frames 2*a* extending outward from the body just behind the head pipe 7 and then extending rearward parallel to each other. Seat rails 2*b* extend rearward from the approximate centers of the main frames 2*a*. Pivot portions 2*c* are formed in the lower rear portions of the main frames 2*a*.

A pivot shaft 11 lies between the right and left pivot portions 2*c*. A swing arm 12 pivots on the pivot shaft 11, and a rear wheel 13 rotates at the rear end of the swing arm 12.

As shown in FIGS. 1–5, the shape of the engine 3 is mainly formed by a crankcase 14 and the cylinder assembly 18 which includes a cylinder block 15, a cylinder head 16, and a cylinder head cover 17. The engine 3 useful with the present invention is of a water-cooled V-type in which several cylinder assemblies, two cylinder assemblies 18F and 18R in this embodiment, are positioned on the crankcase 14.

The crankcase 14 is divided into right and left crankcase segments 14L and 14R along the widthwise direction of the vehicle by a vertical dividing surface 14*a*. The two cylinder assemblies 18F and 18R are placed behind the right and left crankcase segments 14L and 14R and parallel to the dividing surface 14*a* so that they form a V-shaped profile.

The engine 3 is also a four-stroke-cycle type having double overhead camshaft (DOHC) valve mechanisms 21, each of which have an intake valve 19*a* and an exhaust valve 19*b*. Two camshafts 20*a* and 20*b* in the upper part of cylinder head 16 open and close valves 19*a* and 19*b* below, respectively.

An engine exhaust system 22 comprising an exhaust pipe 22*a* and a muffler 22*b* connect to the front of the front cylinder assembly 18F and to the rear of the rear cylinder assembly 18R. An engine intake system 23 comprising throttle bodies 23*b*, each having a fuel injector 23*a*, connect to the rear of the front cylinder assembly 18F and to the front of the rear cylinder assembly 18R. An air cleaner 23*c*, positioned below the fuel tank 4, connects to the upstream sides of the throttle bodies 23*b* via intake pipes 23*d*. An engine cooling system 24 comprising a radiator 24*a* sits on the lower rear side of the head pipe 7 and on the upper front side of the engine 3.

A crankshaft 25 in the crankcase 14 lies along the widthwise direction of the vehicle, i.e. perpendicular to the moving direction of the motorcycle. Near the center of the crankshaft 25, the large end 27*a* of a connecting rod 27 is coupled to the crank pin 26, and the smaller end 27*b* of the connecting rod 27 is coupled to a piston 29 via a piston pin 28. Due to the motion of the connecting rod 27, the piston 29 reciprocates in the axial direction within the cylinder bore 30 which is inside the cylinder block 15. This reciprocal stroke causes the connecting rod 27 to rotate crankshaft 25. The crankshaft 25 in turn transmits the driving force through the clutch mechanism 35 to the counter shaft 36.

Figure 3:
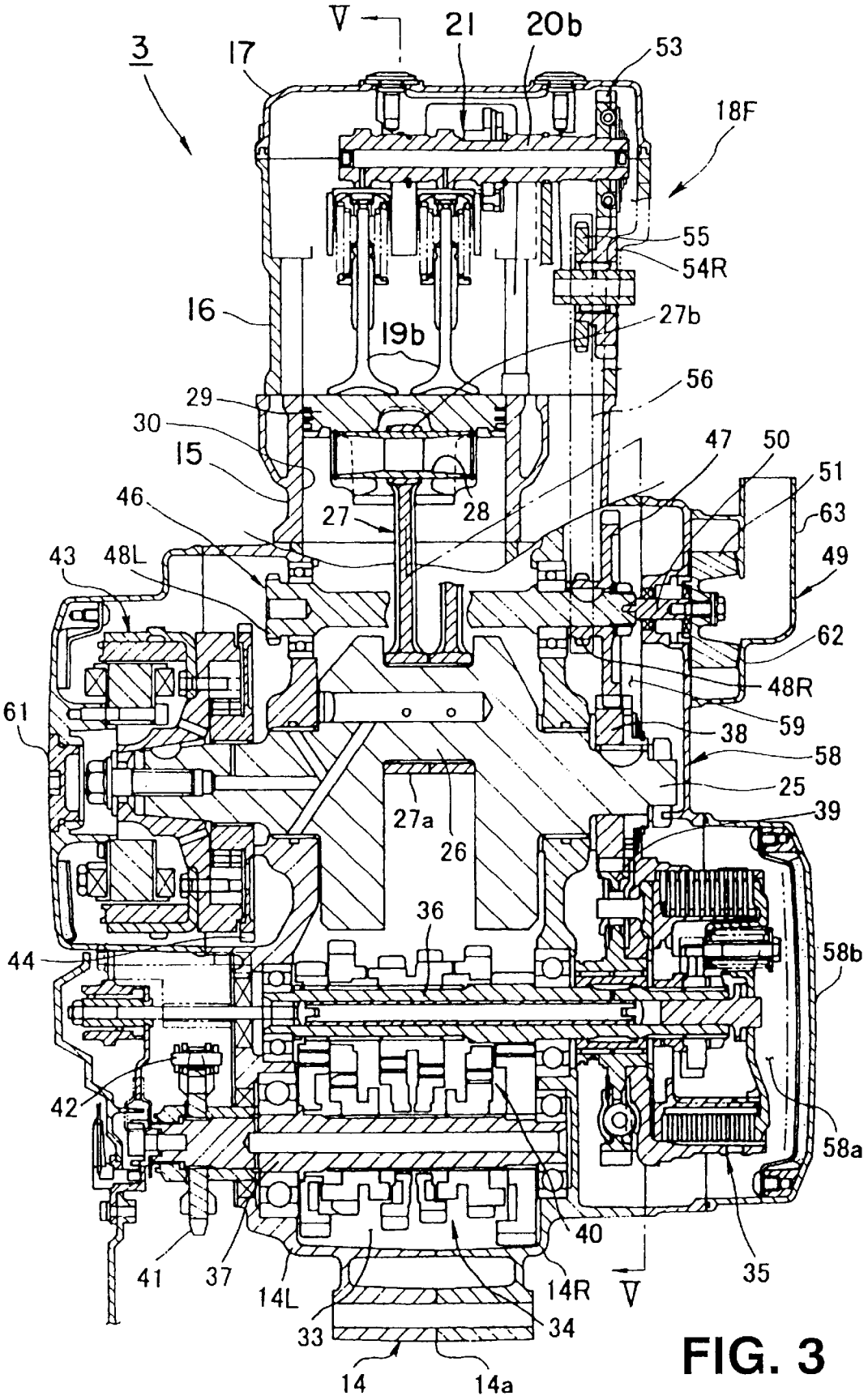
FIG. 3 is a sectional view, taken along line III—III of FIG. 2.
Figure 4:
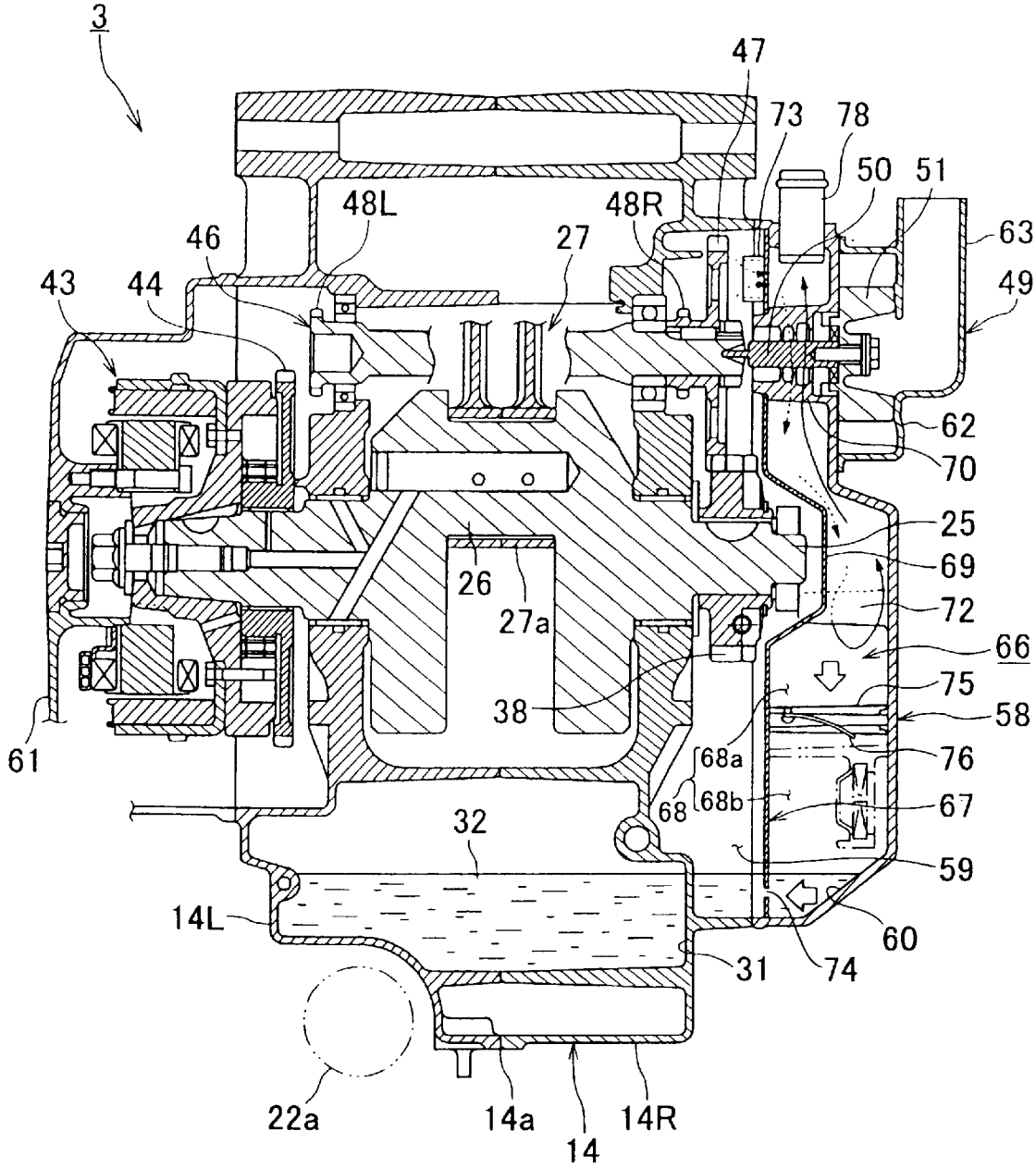
FIG. 4 is a sectional view, taken along line IV—IV of FIG. 2.

As shown in FIG. 4, an oil pan 31 under the crankcase 14 stores lubricating oil 32. In the rear of this crankcase 14, as shown in FIG. 3, a transmission chamber 33 houses the transmission mechanism 34 which serves as a reduction device. The transmission mechanism 34 includes the counter shaft 36 which is parallel to the crankshaft and a driving shaft 37 which outputs the driving force to the rear wheel 13.

A primary driving gear 38 rotates on the right end of the crankshaft 25, in this embodiment. Connected to this gear, a primary driven gear 39 rotates on the right end of the counter shaft 36. The primary driven gear 39 rotates the clutch mechanism 35 thereby transmitting the rotational driving force of the crankshaft 25 to the clutch mechanism 35.

The counter shaft 36 and the driving shaft 37 have several transmission gears 40 that have different numbers of teeth, and primary speed reduction is accomplished by changing the combination of these gears 40.

A driving sprocket 41 is placed on the end of the driving shaft 37 and is coupled to a driven sprocket (not shown) at the rear wheel 13 by a driving chain 42. This driving chain 42 performs secondary speed reduction by transmitting the engine driving force to the rear wheel 13.

The left end of the crankshaft 25 also protrudes from the left crankcase 14L. An AC generator 43 and a starter driven gear 44 are mounted at the protruding end and are covered with a generator cover 61. The starter driven gear 44 is coupled to a starter driving gear (not shown) of a starter motor 45 at the front of the engine 3.

A cam-chain idler shaft 46 is parallel to and above the crankshaft 25, between the front and rear cylinder assemblies 18F and 18R. This cam-chain idler shaft 46 rotates with the crankshaft 25 and drives the valve mechanisms 21. An idler-shaft driven gear 47 and a primary driving gear 38 rotate on the right ends of the cam-chain idler shaft 46 and crankshaft 25, respectively. These gears are coupled to transmit the rotational driving force from the crankshaft 25 to the cam-chain idler shaft 46.

A pair of right and left cam-chain driving sprockets 48R and 48L drive the valve mechanisms 21 and are mounted on both sides of the cam-chain idler shaft 46. The end of the cam-chain idler shaft 46 on which the idler-shaft driven gear 47 is mounted is coupled to the left end of a pump shaft 50. The pump shaft 50 is part of a cooling-water pump 49 and is another shaft that rotates with the crankshaft 25. Also included in the cooling-water pump 49 is an impeller 51 on the right end of the pump shaft 50.

The camshafts 20*a* and 20*b* in each cylinder block 16 have cam sprockets 53 at one end which are coupled via cam-driving idle gears 54F and 54R.

Cam-chain driven sprockets 55 are attached coaxially to the cam-driving idle gears 54F and 54R. A chain tensioner 57 maintains the tension of the cam chains 56 that couple these sprockets 55 to the cam-chain driving sprockets 48L and 48R which are mounted on the cam-chain idler shaft 46. The crankshaft 25 rotates the camshafts 20*a* and 20*b* via the cam-chain idler shaft 46 in order to operate the valve mechanism 21.

The right ends of the crankshaft 25, the counter shaft 36 and the cam-chain idler shaft 46 protrude from the right crankcase 14R. The primary driving gear 38, the primary driven gear 39, the clutch mechanism 35, the right cam-chain driving sprocket 48R, and the idler-shaft driven gear 47 are mounted at these protruding ends.

A side cover 58 which covers these gears and the like forms a gear chamber 59 between a side wall of the right crankcase 14R and the side cover 58. A lubricating oil storage section 60 is formed under the gear chamber 59, as shown in FIG. 4. The lubricating oil storage section 60 under the gear chamber 59 connects with the oil pan 31.

Figure 5:
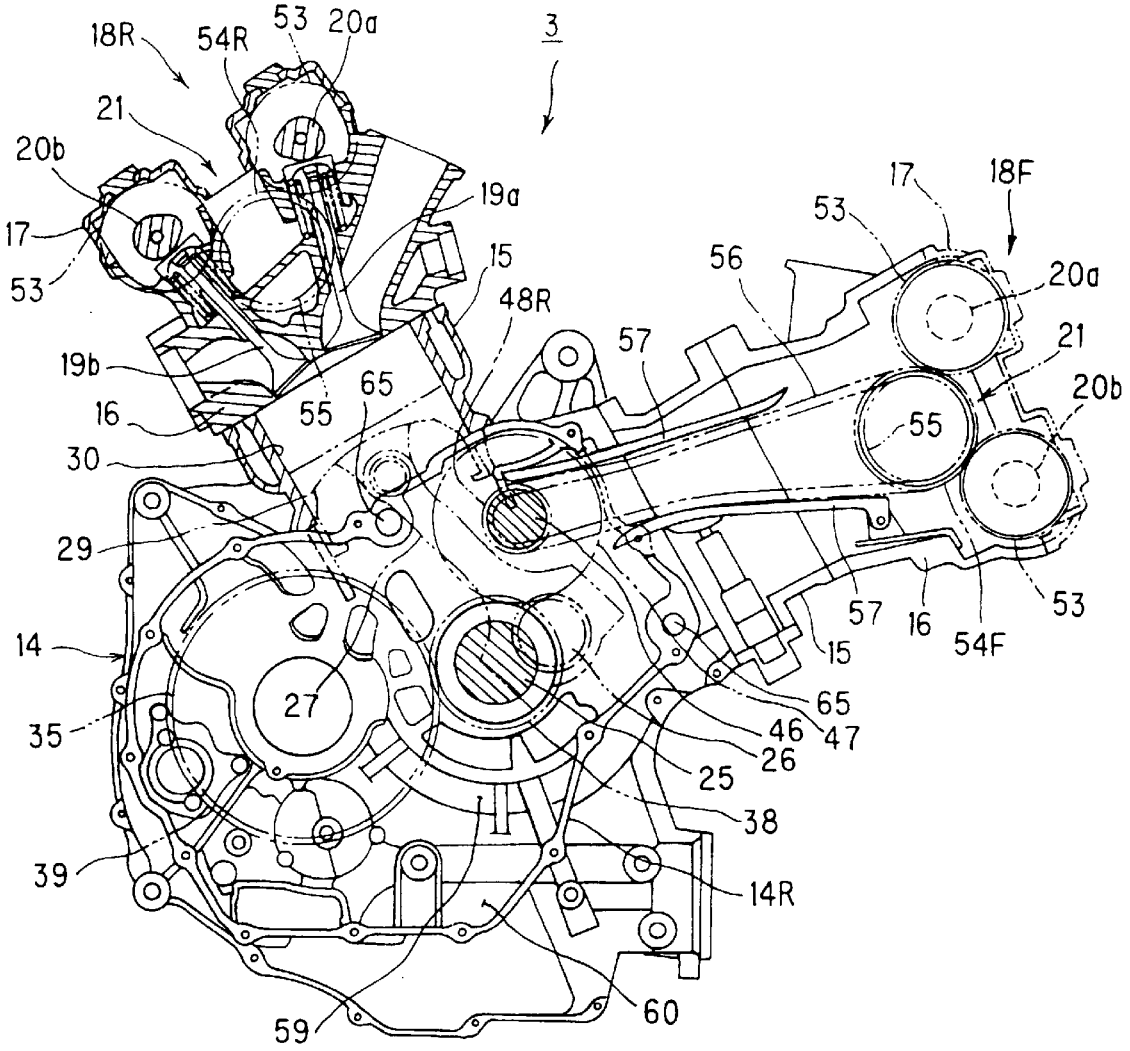
FIG. 5 is a sectional view, taken along line V—V of FIG. 3.
Figure 6:
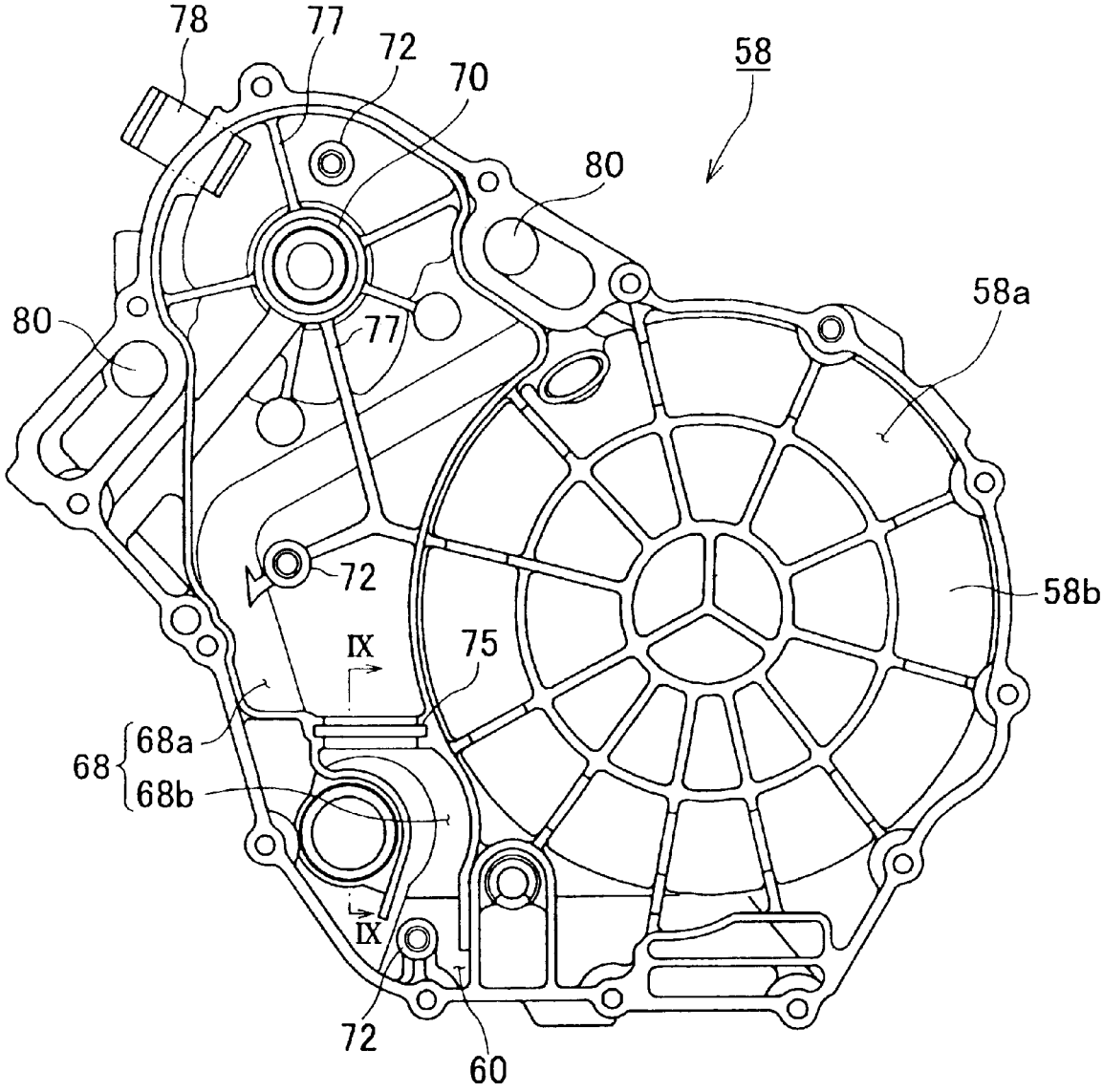
FIG. 6 is an explanatory view of a side cover, as viewed from a joint surface with the right crankcase.
Figure 7:
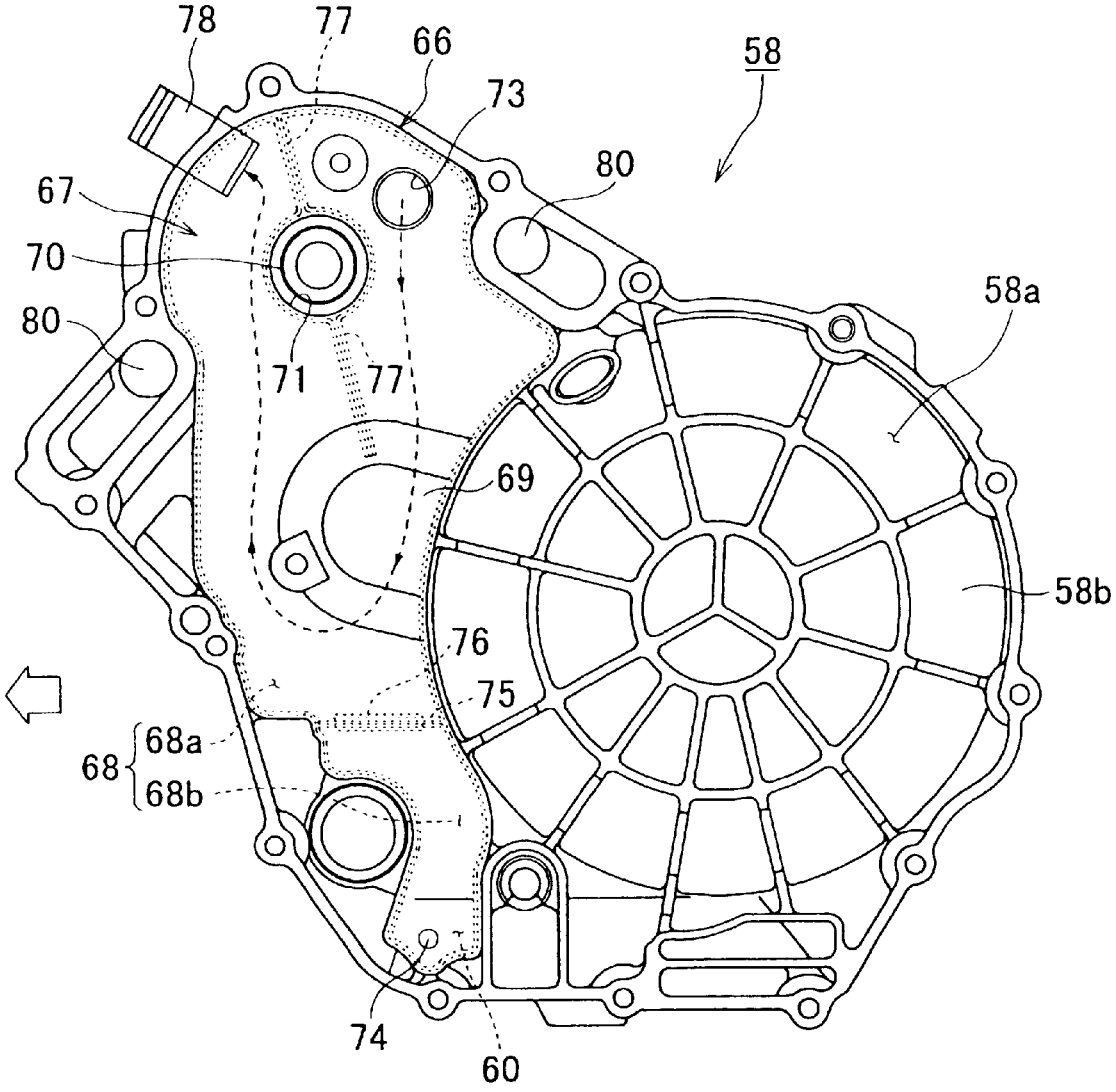
FIG. 7 is an explanatory view showing an oil separator mounted on the side cover shown in FIG. 6.
Figure 8:
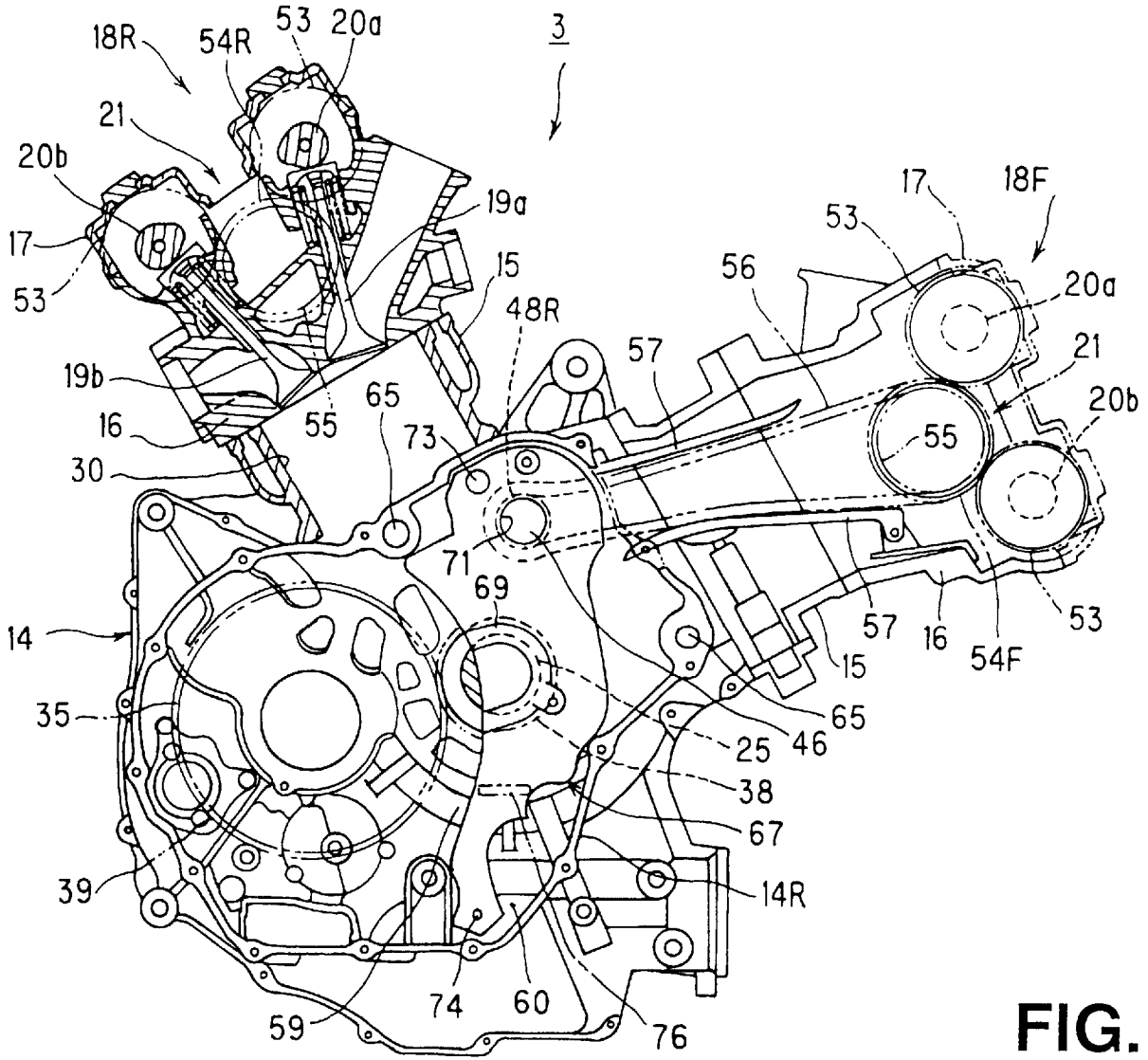
FIG. 8 is an explanatory view showing the positional relationship between the oil separator and the engine shown in FIG. 5.

A side face of the clutch-mechanism housing portion 58*a* of the side cover 58 has an opening that is closed by a clutch cover 58*b*. FIG. 5 is a right side view of the engine 3 when this side cover 58 is removed.

As shown in FIGS. 3 and 4, the right end of the pump shaft 50 protrudes from the side cover 58. The impeller 51 is mounted on the protruding end as part of the cooling-water pump 49 which also has a casing 62. A cooling-water hose 64 extends from a union 63 mounted on the casing 62 toward the radiator 24*a* (see FIG. 2). Cooling water discharge openings 65 in the wall of the right crankcase 14R are formed in front of and behind the pump shaft 50 (see FIG. 5).

The engine 3 includes a breather device 66 that allows blow-by gas to escape from the crankcase 14 and that separates oil mist from the blow-by gas. As shown in FIGS. 4–9, an oil separator 67 in the breather device 66 is located at a surface between the side cover 58 and the right crankcase 14R.

A breather chamber 68 is formed within a portion of the side cover 58 in front of the clutch-mechanism accommodating portion 58*a* and on the right side of the crankshaft 25. This breather chamber 68 is closed by the platelike oil separator 67 that is located along the inner edge of and inside the side cover 58. Close to the center of the oil separator 67, there is an exit 69 for the right end of the crankshaft 25. The left end of a raised portion or support boss 70 on the inside of the upper side cover 58 projects into the pump shaft 50 through a fitting hole 71. The oil separator 67 is fixed, for example, by screws (not shown) to several cover-fixing bosses 72 projecting from the inner side of the side cover 58.

The oil separator 67 also has a breather entrance 73 that joins the gear chamber 59 of the right crankcase 14R and the breather chamber 68. The breather entrance 73 is formed diagonally above the fitting hole 71 and adjacent to the idler-shaft driven gear 47 which serves as the rotary member.

An oil return hole 74 at the lower end of the oil separator 67 joins the lubricating-oil storage section 60 in the gear chamber 59 (i.e., the oil pan 31) and the breather chamber 68. During the normal operation of the motorcycle, the oil return hole 74 sits below the lubricating-oil surface in the oil pan 31 and in the lubricating-oil storage section 60.

Figure 9:
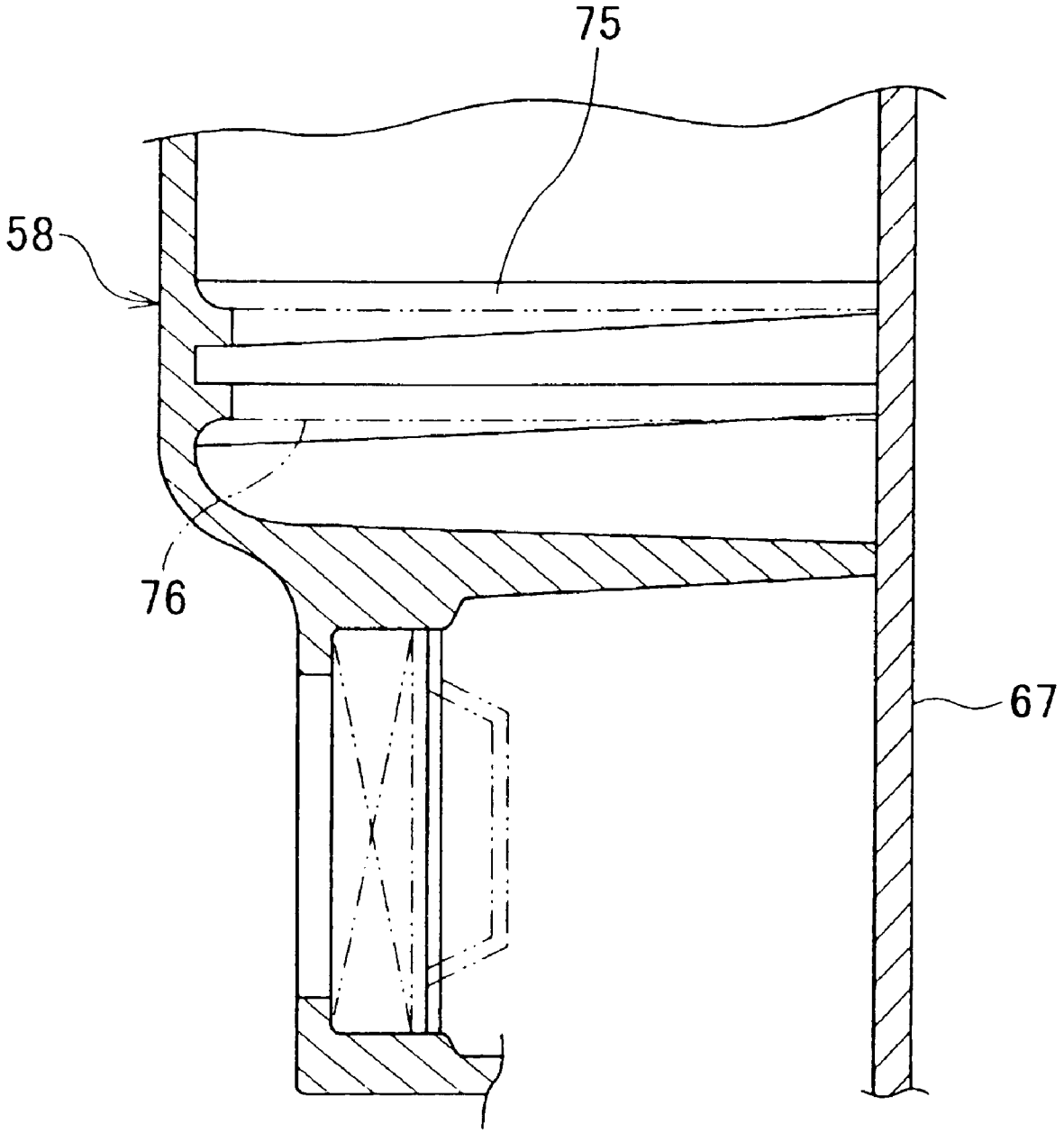
FIG. 9 is a sectional view, taken along line IX—IX of FIG. 6.

An extended portion 75 connects the inside of the side cover 58 above the oil return hole 74 and below the right end of the crankshaft 25 to the outside of the oil separator 67, as shown in FIG. 9. The extended portion 75 divides the breather chamber 68 into an upper segment 68*a* and a lower segment 68*b*. A lead valve 76 in the extended portion 75 is fixed to the oil separator 67 and allows the lubricating oil 32 to flow only from the upper segment 68*a* of the breather chamber 68 into the lower segment 68*b*.

Figure 2:
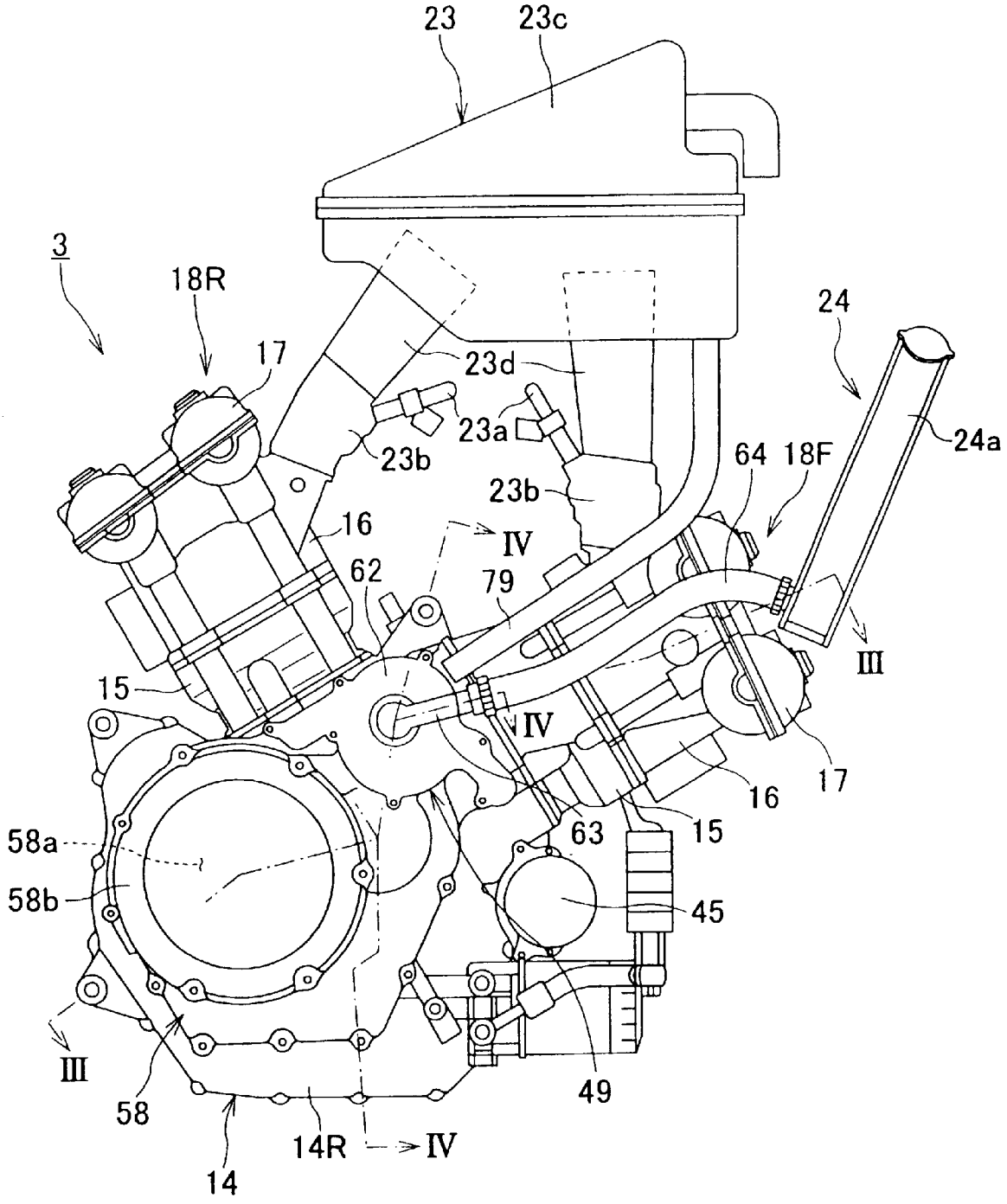
FIG. 2 is a right side view of a motorcycle engine.

A rib-shaped partition 77 formed on the inner surface of the side cover 58 extends approximately vertically and adjacent to the fitting hole 71 for the pump-shaft support boss 70, thereby forming the maze-like upper segment 68*a* of the breather chamber 68. A breather union 78 serving as a breather exit is mounted in the side cover 58 across the partition 77 from the breather entrance 73. As shown in FIG. 2, the breather union 78 and the air cleaner 23*c* are connected by a breather hose 79.

Cooling-water paths 80 in the side cover 58 connect to the cooling-water discharge openings 65 formed in the wall of the right crankcase 14R and are covered with the casing 62 of the cooling-water pump 49.

During operation of the engine 3, pressurized gas produced in the cylinder bore 30 flows or blows by the separation between the piston 29 and the cylinder bore 30 and gradually leaks into the crankcase 14. Oil mist is mixed in the blow-by gas.

The blow-by gas leaks through the breather entrance 73 in the oil separator 67 of the breather device 66. The oil separator 67 is housed between the right crankcase 14R and the side cover 58. The blow-by gas then flows into the breather chamber 68 contained within the side cover 58 and the oil separator 67.

The idler-shaft driven gear, which serves as the rotary member, removes most of the oil in the blow-by gas by centrifugal force. Due to the proximity of the breather entrance 73 to this idler-shaft driven gear 47, this oil is removed before the blow-by gas flows into the breather chamber 68 through the breather entrance 73.

Oil is further separated from the blow-by gas within the maze-shaped upper segment 68*a* of the breather chamber 68 inside the side cover 58. As shown by the arrows in FIGS. 4 and 7, the blow-by gas flowing into the breather chamber 68 through the breather entrance 73 is forced downward by the approximately vertical rib-shaped partition 77. The blow-by gas then passes under the pump-shaft support boss 70, to the exit 69 at the right end of the crankshaft 25 and then to the opposite side of the partition from the breather entrance 73. The blow-by gas escapes from the breather chamber 68 through the breather union 78, is guided to the air cleaner 23*c*, mixes with new air and is burned again in the engine 3.

The oil separated from the blow-by gas in the maze-shaped upper segment 68*a* of the breather chamber 68 falls naturally due to gravity. The oil is guided to the lower segment 68*b* of the breather chamber 68 through the lead valve 76 which serves as the check valve and is returned to the oil pan 31 through the oil return hole 74 at the lower end of the oil separator 67.

The clutch-mechanism accommodating portion 58*a* of the side cover 58 projects along the widthwise direction of the motorcycle in the engine 3. When the breather chamber 68 is placed in front of the clutch-mechanism accommodating portion 58*a* and on the right side of the crankshaft 25, the width of the engine 3 is not increased. Moreover, since this space is typically not used, this configuration effectively utilizes existing space.

Between the front and rear cylinder assemblies 18F and 18R, the cam-chain idler shaft 46 is parallel to and rotates just above the crankshaft 25. The end of the cam-chain idler shaft 46 is coupled to the cooling-water pump 49 consisting of the pump shaft 50. The end of the pump shaft 50 protrudes from the side cover 58, and the cooling-water pump 49 is positioned on the outer surface of the side cover 58. Therefore, the space between the back of the cooling-water pump 49 and the idler-shaft driven gear 47 can be effectively utilized as the breather chamber 68.

Since the cooling-water pump 49 is in front of the clutch-mechanism accommodating portion 58*a*, the width of the engine 3 is not increased. Furthermore, since the cooling-water pump 49 is placed between the front and rear cylinder assemblies 18F and 18R, cooling water can be uniformly circulated to the cylinder assemblies 18F and 18R.

The oil return hole 74 that joins the oil pan 31 and lubricating-oil storage section 60 in the gear chamber 59 with the breather chamber 68 is formed at the lower end of the oil separator 67. This hole 74 lies below the level of lubricating-oil in the oil pan 31 and in the lubricating-oil storage section 60 while the motorcycle is in operation. Therefore, the lubricating oil 32 separated from the blow-by gas and stored in the lower segment 68*b* of the breather chamber 68 can be re-circulated into the oil pan 31.

Since the breather entrance 73 of the oil separator 67 is formed adjacent to the rotary member that separates the oil from the blow-by gas, the blow-by gas can flow into the breather chamber 68 without the oil mist.

The extended portion 75 connects the inside of the side cover 58 above the oil return hole 74 and below the right end of the crankshaft 25 to the outside of the oil separator 67, thereby dividing the breather chamber 68 into the upper segment 68*a* and the lower segment 68*b*. Therefore, maintenance of the clutch mechanism 35 can be performed by simply detaching the side cover 58, and the oil separator 67 can be attached without using another means such as a fastening member. This makes maintenance easier.

The extended portion 75 contains the lead valve 76 that serves as a check valve to allow only lubricating oil 32 to flow from the upper segment 68*a* of the breather chamber 68 to the lower segment 68*b*. Therefore, the lubricating oil 32 in the oil pan 31 will not backflow from the breather entrance 73 and the breather union 78 if the motorcycle tilts.

Since the cam-chain idler shaft 46 driving the valve mechanism 21 is coaxial to the pump shaft 50 driving the impeller 51 of the cooling-water pump 49, the engine 3 is more compact. The remaining space can be used for other engine accessories.

A large torque is applied to the cooling-water pump 49 that delivers cooling water. This torque acts on the cam-chain idler shaft 46 to which the pump shaft 50 of the cooling-water pump 49 is coupled and can be reduced by mounting the pair of cam-chain driving sprockets 48L and 48R for driving the valve mechanisms 21 at both ends of the cam-chain idler shaft 46. This places the idler-shaft driven gear 47, which is coupled to the primary driving gear 38 of the crankshaft 25, adjacent to one of the cam-chain driving sprockets 48R and places the cooling-water pump 49 on the same side as the idler-shaft driven gear 47. As a result, engine endurance increases.

The invention described above is the preferred embodiment, but the present invention is not limited to the disclosed embodiment. On the contrary, the invention is intended to cover various modifications and equivalent arrangements included within the spirit and scope of the appended claims.

What is claimed is:

1. A water-cooled V-type motorcycle engine having a breather device, said engine comprising:

a crankcase having a front, a rear, and two or more side walls;

a crankshaft extending in said crankcase in the widthwise direction of said motorcycle;

a plurality of front and rear cylinder assemblies arranged on said crankcase so as to form a V-shaped profile;

a clutch mechanism provided on the rear side of said crankcase;

a side cover covering a side wall of said crankcase at which said clutch mechanism and an end of said crankshaft are located, a breather chamber inside said side cover covering a portion of said side cover in front of said clutch mechanism, said breather chamber formed by a platelike oil separator and the side of said crankshaft with a platelike oil separator;

a shaft that rotates with said crankshaft located in parallel with said crankshaft between said front and rear cylinder assemblies and above said crankshaft; and a cooling-water pump driven by said shaft and located on the outer surface of said side cover.

2. An engine according to claim 1, further comprising an oil pan for storing lubricating oil located under said crankcase, and an oil return hole located at a lower end of said oil separator so as to join said oil pan and said breather chamber, whereby said oil return hole is located under the surface of lubricating oil in said oil pan in an operational state of said motorcycle.

3. An engine according to claim 1, wherein a breather entrance is located in said oil separator adjacent to a rotary member.

4. An engine according to claim 1, wherein said breather chamber is divided into an upper segment and a lower segment by an extended portion located inside said side cover above said oil return hole and below said end of said crankshaft so that said extended portion reaches the surface of said oil separator.

5. An engine according to claim 4, wherein said extended portion includes a check valve adapted to allow lubricating oil to flow unidirectionally from said upper segment of said breather chamber into said lower segment of said breather chamber.

6. An engine according to claim 1, wherein a shaft for driving a valve mechanism is located coaxial to a shaft for driving said cooling-water pump.

7. An engine according to claim 6, wherein a pair of sprockets for driving said valve mechanism is located at the ends of said shaft for driving said valve mechanism to which said shaft for driving said cooling-water pump is coupled, a gear coupled to said crankshaft is located adjacent to one of said sprockets for driving said valve mechanism, and said cooling-water pump is located on the same end of said shaft for driving said valve mechanism as said gear.

* * * * *